US007104098B2

(12) United States Patent
Romero et al.

(10) Patent No.: US 7,104,098 B2
(45) Date of Patent: Sep. 12, 2006

(54) FRONT LOADING LOCK ASSEMBLY

(75) Inventors: Oscar Romero, Lake Forest, CA (US); Steve Armstrong, Anaheim Hills, CA (US); Gerald B. Chong, Rowland Heights, CA (US)

(73) Assignee: Newfrey LLC, Newark, DE (US)

( * ) Notice: Subject to any disclaimer, the term of this patent is extended or adjusted under 35 U.S.C. 154(b) by 101 days.

(21) Appl. No.: 10/837,789

(22) Filed: May 3, 2004

(65) Prior Publication Data

US 2005/0241350 A1 Nov. 3, 2005

(51) Int. Cl.
*E05B 13/10* (2006.01)

(52) U.S. Cl. ..... 70/224; 70/368; 70/370; 70/371; 70/451; 292/353; 403/329

(58) Field of Classification Search ..... 70/368, 70/370, 371, 367, 369, 451, 224, 210, 466, 70/372, 375, 215–217, DIG. 31, DIG. 39; 292/353; 403/329
See application file for complete search history.

(56) References Cited

U.S. PATENT DOCUMENTS

| | | | | | |
|---|---|---|---|---|---|
| 724,708 | A * | 4/1903 | Jones | 279/77 |
| 1,990,794 | A * | 2/1935 | McCormac | 70/368 |
| 2,156,486 | A * | 5/1939 | Wertz | 292/354 |
| 2,476,458 | A * | 7/1949 | Schoepe | 70/224 |
| 2,620,649 | A * | 12/1952 | Bernardo | 70/358 |
| 3,177,024 | A * | 4/1965 | Krook et al. | 292/353 |
| 3,196,644 | A * | 7/1965 | Russell et al. | 70/224 |
| 3,722,243 | A * | 3/1973 | Schiesterl | 70/369 |
| 3,776,008 | A * | 12/1973 | Schlage | 70/368 |
| 3,780,549 | A * | 12/1973 | Schlage | 70/358 |
| 3,793,857 | A * | 2/1974 | Schlage | 70/368 |
| 4,099,397 | A * | 7/1978 | Dauenbaugh | 70/371 |
| 5,038,589 | A * | 8/1991 | Martin | 70/368 |
| 5,186,031 | A * | 2/1993 | Janssen et al. | 70/277 |
| 5,317,889 | A * | 6/1994 | Solovieff et al. | 70/224 |
| 5,884,512 | A | 3/1999 | Wayne | |
| 6,202,457 | B1 | 3/2001 | Hsueh et al. | |
| 6,301,942 | B1 | 10/2001 | Shvarts | |
| 6,357,270 | B1 * | 3/2002 | Vazquez | 70/472 |
| 6,533,336 | B1 * | 3/2003 | Kemp et al. | 292/348 |
| 6,604,392 | B1 | 8/2003 | Kiso et al. | |
| 6,637,243 | B1 | 10/2003 | Lemley et al. | |
| 6,695,365 | B1 * | 2/2004 | Chong et al. | 292/348 |

* cited by examiner

*Primary Examiner*—Lloyd A. Gall
(74) *Attorney, Agent, or Firm*—Carlson, Gaskey & Olds

(57) ABSTRACT

A lock assembly for a keyed knob includes an insert, a cylinder assembly and a retainer. The insert is inserted into the knob after the retainer is attached thereto. The insert is inserted from the rear of the knob and attached thereto. The cylinder assembly is then inserted into the front of the insert until the retainer engages the cylinder assembly to secure the cylinder assembly into the insert. The cylinder assembly is readily removed by pressing on a step portion of the retainer with a tool inserted through the rear of the knob.

27 Claims, 3 Drawing Sheets

FRONT LOADING LOCK ASSEMBLY

BACKGROUND OF THE INVENTION

The present invention relates to a lock assembly, and more particularly to a mounting arrangement for a cylinder assembly into a keyed knob assembly.

Numerous types of conventional lock assemblies are utilized for various applications. Homes and commercial establishments are protected predominantly by key-actuated pin tumbler locks. In a typical lock, a cylinder assembly houses a rotational cylindrical plug having a longitudinally extending keyway. A driving member, such as a cam, is connected to the rear face of the plug. The driving member actuates a bolt-throwing or latch-moving mechanism.

The interface between the plug and the cylinder is called the shear line. A plurality of radially extending, parallel chambers is formed in the cylinder and the plug. Spring-biased pins are disposed in each chamber. Under normal conditions, the drivers block the shear line to prevent the plug from being rotated relative to the cylinder. However, when a properly configured key is inserted into the keyway, the drivers and lower pins are moved so that the top of the lower pins and the bottom of the drivers meet at the shear line. The plug can then be rotated to cause rotation of the driving member and subsequent retraction or extension of the bolt or latch.

Locksmiths frequently rekey or replace residential or commercial locks. To this end, interchangeable cylinder assemblies are manufactured by various lockmakers. Disadvantageously, the interchangeable cylinder assemblies are relatively complicated. Typically, the interchangeable cylinder assembly, even those from a single manufacturer, is specific to a particular lock type and include mounting structure specific thereto. For example, a knob lock assembly, a lever lock assembly, and deadbolt lock assembly each utilize a cylinder assembly particular to a knob, a lever, and a deadbolt respectively. Such an arrangement complicates rekeying and replacement of residential and commercial locks.

Accordingly, it is desirable to provide an uncomplicated mounting arrangement for a cylinder assembly that is readily mounted into multiple lock types.

SUMMARY OF THE INVENTION

The lock assembly for a keyed knob according to the present invention includes an insert, a cylinder assembly, and a retainer. The retainer fits upon the insert and includes a first arcuate leg, a second arcuate leg, and a spring catch which extends perpendicularly therefrom. A pair of tabs extend generally perpendicularly from the spring catch. The spring catch further includes a step portion intermediate the tab and the arcuate legs.

The insert is inserted into the knob after the retainer is attached thereto. The insert is inserted from the rear of the knob and attached thereto. The cylinder assembly is then inserted from the front of the knob. As the cylinder assembly is pushed into the bore of the insert, an extension which guides the cylinder assembly into the bore pushes past the tabs until the tabs engage a retainer groove on the cylinder assembly to secure the cylinder assembly into the insert.

The cylinder assembly is readily removed by pressing on the step portion of the spring clip with a tool inserted through the rear of the knob. The tool pushes forward on the step portion which lifts the tabs out of the retainer groove such that the cylinder assembly can be extracted from the front of the knob. Disassembly is readily achieved, yet when the knob is installed, cylinder assembly removal is effectively prevented.

The present invention therefore provides an uncomplicated mounting arrangement for a cylinder assembly that is readily mounted into a multiple of lock types.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
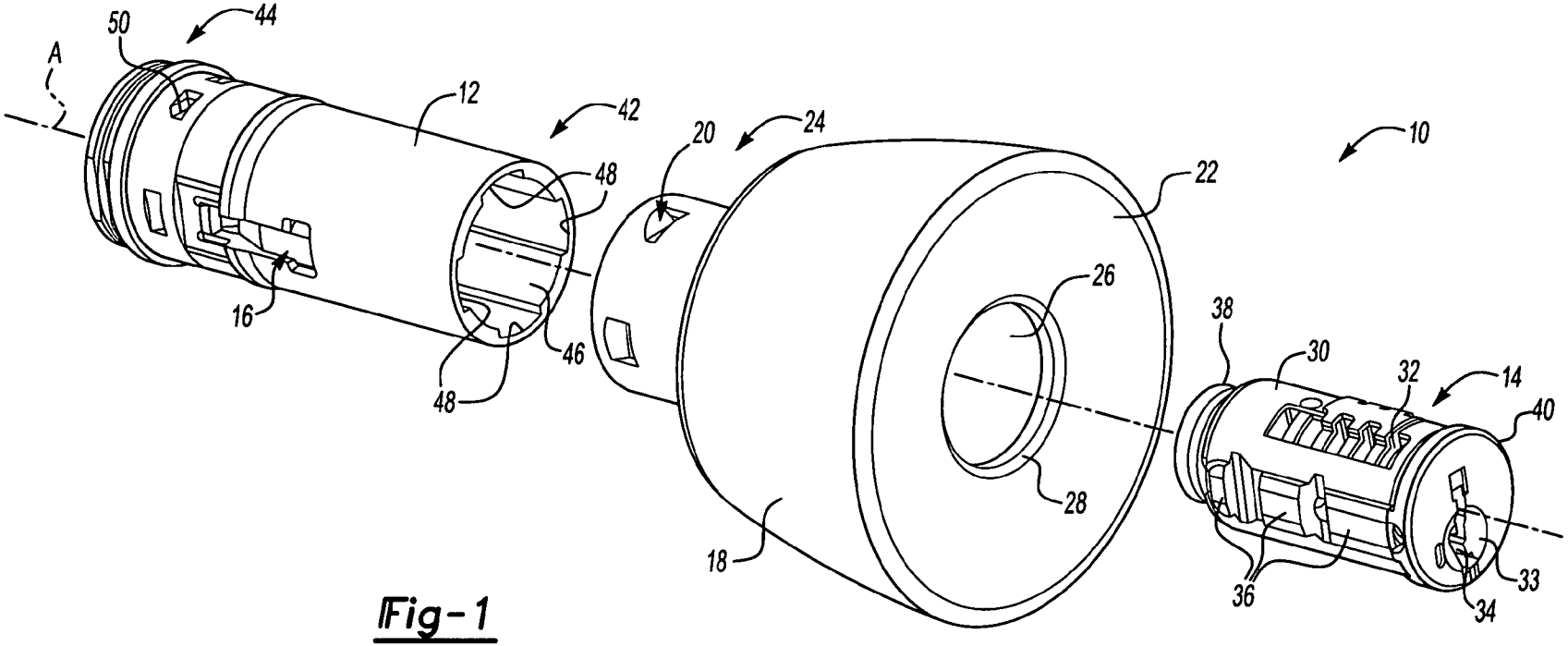
FIG. 1 is an exploded view of a lock assembly according to the present invention.

FIG. 1 illustrates a general exploded perspective view of a lock assembly 10. The lock assembly generally includes an insert 12, a cylinder assembly 14, and a retainer 16.

The insert 12 and the cylinder assembly 14 are received within a knob 18 to form a keyed knob assembly. It should be understood that although a particular component configuration is disclosed in the illustrated embodiment, other arrangements will benefit from the instant invention.

The insert 12 supports and protects the cylinder assembly 14. The insert 12 is preferably receivable into a lock type such as the knob 18 and is secured thereto through a multiple of stakes 20 (also illustrated in FIG. 3). Although a knob assembly is illustrated in the disclosed embodiment, it should be understood that other inserts for other lock assemblies, such as a lever, will also benefit from the present invention.

The knob 18 is preferably manufactured as a one-piece component. The knob 18 includes a front face 22 and a rear segment 24. The knob 18 is generally hollow and the rear segment 24 is preferably cylindrical to be received within a lock structure mounted to a door or the like. It should be understood that relative positional terms such as "front," "rear," "upper," "lower," "above," "below," and the like are with reference to a normal operational attitude and should not be considered otherwise limiting.

A longitudinally extending bore 26 opens through the knob 18 and defines an axis A. A circumferential recessed face 28 is located within the front face 22 and extends about the periphery of the bore 26.

The cylinder assembly 14 includes a barrel 30 and a rotatable lock cylinder 32. A keyway 34 is defined in a front face 33 of the lock cylinder 32 to permit insertion of a key such that the lock cylinder 32 can be rotated to operate the lock. An actuating member 35 (FIG. 3) extends from within a rear portion 38 of the lock cylinder 32 to engage an actuating plate (not shown) that extends through a latch bolt (not shown), which is conventional and need not be described in detail herein. Operation of the key to pin arrangement may take various conventional forms and need not be described in detail herein.

A cylinder assembly extension 36 extends from the cylinder assembly 14. The extension 36 may be formed in one or more portions to preferably form a rail structure along the longitudinal length of the cylinder assembly 14. It should be understood that various extension shapes and arrangements will benefit from the present invention.

Figure 3:
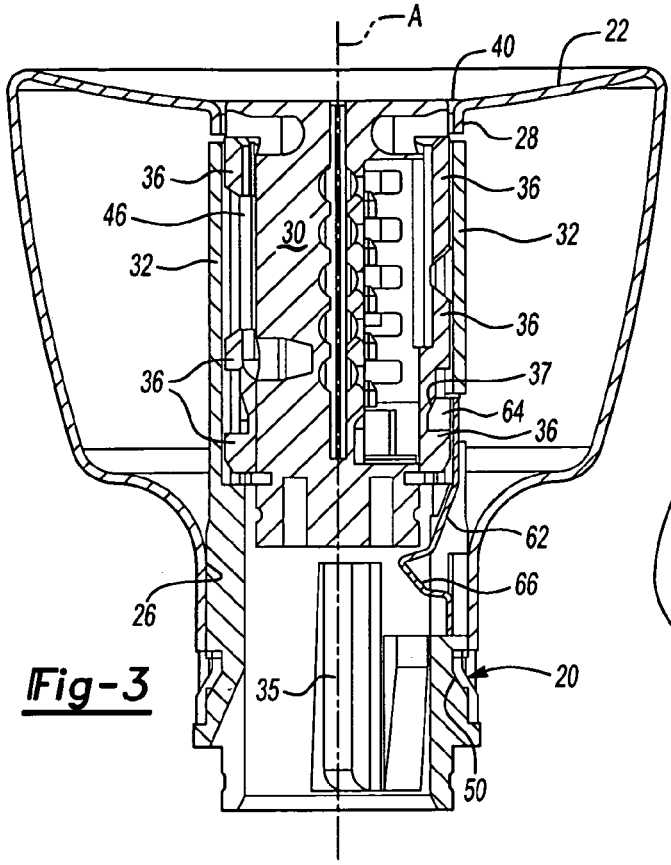
FIG. 3 is a sectional view of a lock assembly with a retainer in an engaged position.

A circumferential flange 40 extends about the perimeter of the barrel 30. The flange 40 is received within the recessed face 28 to control the axial insertion depth of the cylinder assembly 14 into the insert 12 (FIG. 3).

The insert 12 is a generally cylindrical member that includes a front section 42 and a rear section 44. A longitudinally extending bore 46 opens through the front and rear sections 42, 44 along the axis A. Elongate, open-ended grooves 48 are formed within the bore 46 generally parallel to the axis A. The grooves 48 are open through the front section 42. It should be understood that additional grooves may be provided (four shown in FIG. 1) to increase the versatility of the insert 12.

The extension 36 is preferably formed as a portion of the barrel 30 to engage the grooves 48 to prevent relative rotation of the insert 12 and cylinder assembly 14. The extension 36 also assists in guiding the cylinder assembly 14 into the bore 46. A retainer groove 37 is preferably located through and generally transverse to the extension 36.

A multiple of stake receipt indentions 50 are preferably located in the rear section 44 of the insert 12. The indentions 50 permit formation of the stakes 20 to retain the cylinder assembly 14 within the knob 18 (FIG. 3).

Figure 2:
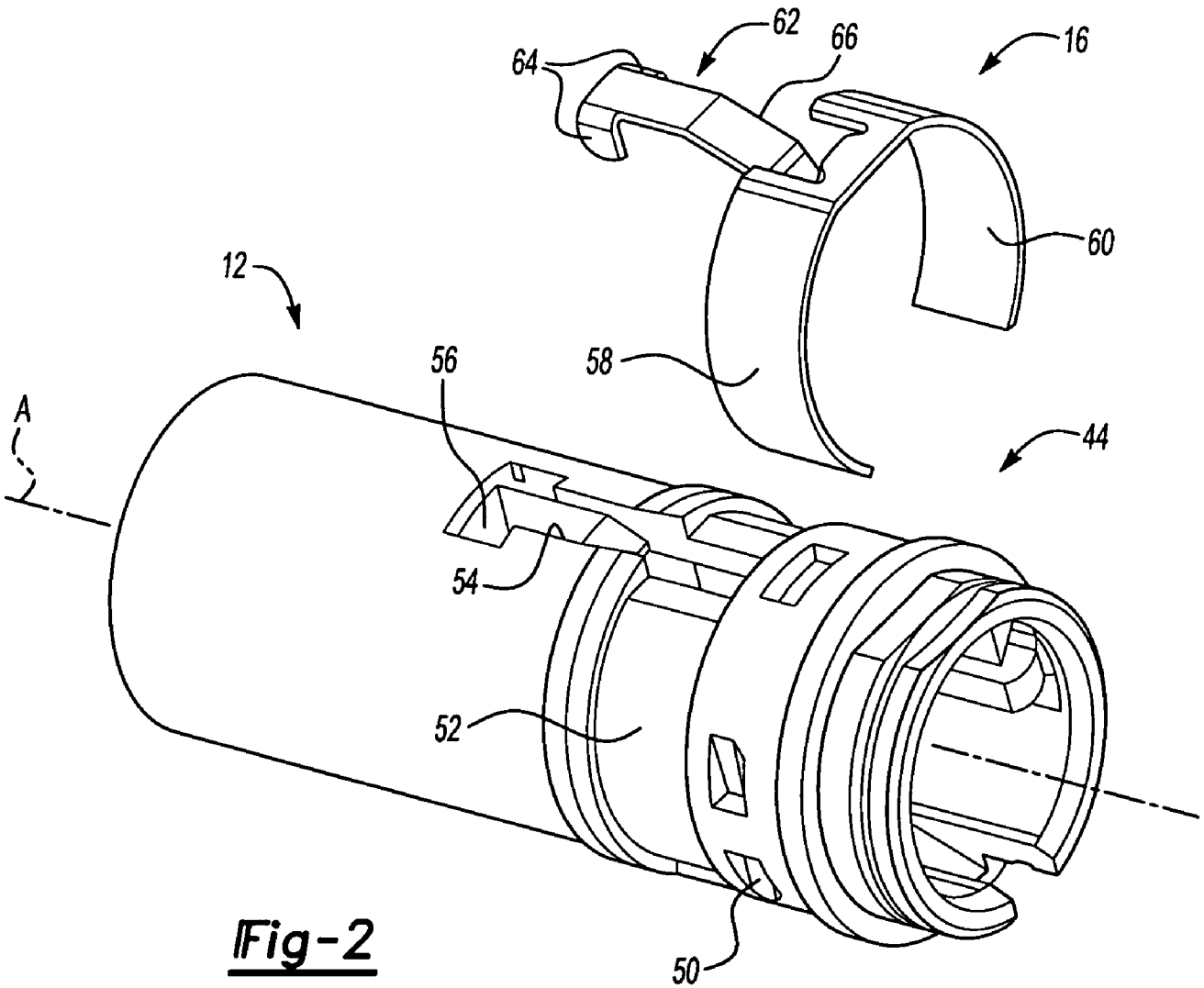
FIG. 2 is an expanded view of a cylinder assembly.

Referring to FIG. 2, the insert 12 includes a peripheral groove 52 that is recessed into the outer periphery of the insert 12. A spring clip groove 54 is located transverse the peripheral groove 52 and is oriented generally parallel to the axis A. The groove 52, 54 are located adjacent the rear section 44 of the insert 12. An opening 56 is located through the insert 12 in an end of the spring clip groove 54.

The retainer 16 includes a first arcuate leg 58, a second arcuate leg 60, and a spring catch 62 which extends perpendicularly therefrom. The legs 58, 60 are defined about the axis A when in an installed position within groove 52 (FIG. 1).

A pair of tabs 64 extend generally perpendicularly from the spring catch 62. The tabs 64 are preferably formed into a distal end of the spring catch 62 and define a U-shape in an end view. The spring catch 62 further includes a step portion 66 intermediate the tab 64 and the arcuate legs 58, 60. It should be understood that the term "step" is not to be construed only as a symmetric structure and shall include other geometries.

Referring to FIG. 3, the insert 12 is inserted into the knob 18 after the retainer 16 is attached thereto (FIG. 1). The insert 12 is preferably inserted from the rear of the knob and staked thereto at stakes 20.

The cylinder assembly 14 is then inserted into the front of the insert 12. The cylinder assembly 14 is pushed into the bore 46 until the circumferential flange 40 engages the recessed face 28 in the knob 18. As the cylinder assembly 14 is pushed into the bore 46 along axis A, the extension 36 pushes past the tab 64 and flexes the spring catch 62 until the tab 64 engages the retainer groove 37. That is, the spring catch 62 flexes to permit the tabs 64 to pass over the segmented extension 36 until the cylinder assembly 14 is fully seated tabs 64 engage the retainer groove 37 to secure the cylinder assembly 14 into the insert 12.

Figure 4:
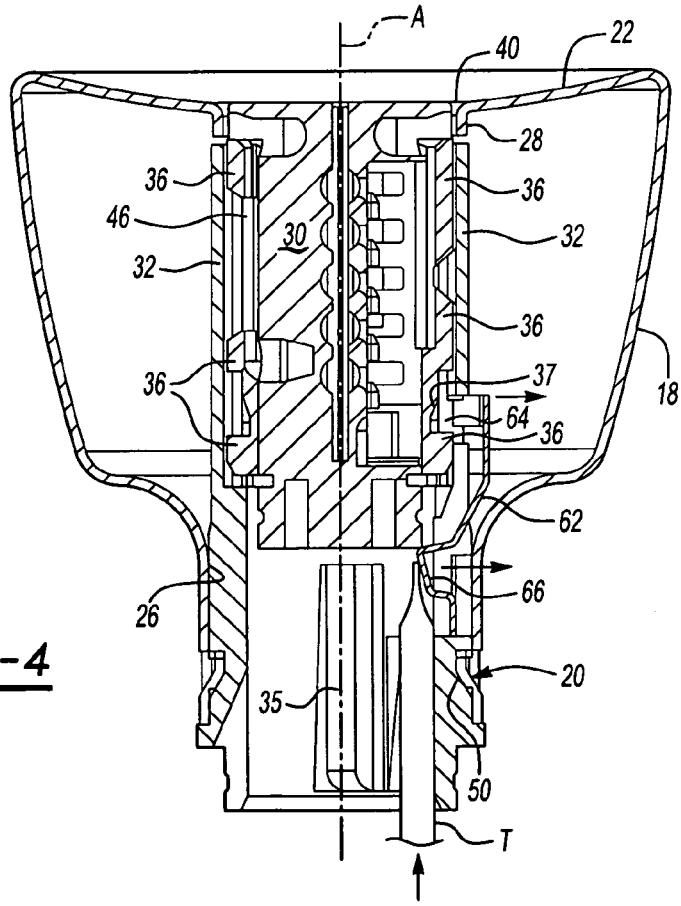
FIG. 4 is a sectional view of a lock assembly with a retainer in a disengaged position.

Referring to FIG. 4, the cylinder assembly 14 is readily removed by pressing on the step portion 66 with a tool T such as a screwdriver or pickle fork inserted through the rear of the knob 18. That is, the tool T pushes forward on the step portion 66 which lifts the tab 64 out of the retainer groove 37 such that the cylinder assembly 14 can be extracted from the front of the knob 18. Disassembly is readily achieved, yet when the knob is installed, cylinder assembly 14 removal is effectively prevented. Moreover, as the cylinder assembly 14 is inserted from the front of the knob, the cylinder assembly 14 is readily assembled into a knob 18, which has been previously mounted to a door.

Figure 5:
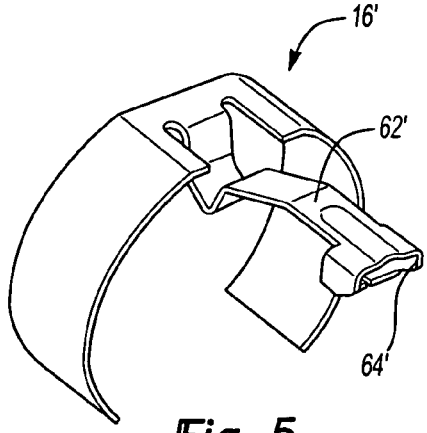
FIG. 5 is a perspective view of another retainer.
Figure 6:
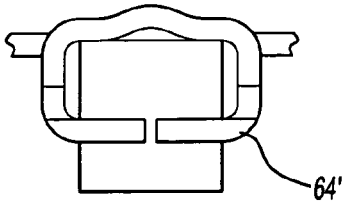
FIG. 6 is an end view of the retainer of FIG. 5.

Referring to FIG. 5, another retainer 16' includes tabs 64' which are formed into a distal end of the spring catch 62' and define a generally box-shape in an end view (FIG. 6).

Although particular step sequences are shown, described, and claimed, it should be understood that steps may be performed in any order, separated or combined unless otherwise indicated and will still benefit from the present invention.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A lock assembly comprising:

an insert which defines an axis, said insert comprises a first groove about a periphery of said insert, a second groove transverse said first groove and an opening through said second groove;

a cylinder assembly receivable within said insert along said axis; and a retainer comprising a spring catch generally parallel to said axis, said retainer engageable with said insert such that said spring catch engages said cylinder assembly to retain said cylinder assembly within said insert, said spring catch comprises at least one tab generally parallel to said axis which extends at least partially through said opening to engage said cylinder assembly to secure said cylinder assembly within said insert.

2. The lock assembly as recited in claim 1, further comprising a flange which extends from said cylinder assembly, said flange at least partially received adjacent a frontal recessed face of a knob.

3. The lock assembly as recited in claim 1, wherein said second groove is generally parallel to said axis.

4. The lock assembly as recited in claim 1, wherein said spring catch is received at least partially within said second groove.

5. The lock assembly as recited in claim 1, wherein said at least one tab comprises a first tab and a second tab which extend perpendicularly from said spring catch.

6. The lock assembly as recited in claim 5, wherein said first tab, said second tab and said spring catch form a generally U-shape.

7. The lock assembly as recited in claim 1, wherein said retainer comprising a first arcuate leg and a second arcuate leg which extend from said spring catch.

8. The lock assembly as recited in claim 7, wherein said first arcuate leg and said second arcuate leg extend at least partially around said insert.

9. The lock assembly as recited in claim 7, wherein said spring catch comprises a tab which extends perpendicularly from said spring catch opposite said first and second arcuate legs.

10. The lock assembly as recited in claim 9, wherein said spring catch comprises a step portion intermediate said tab and said first and second arcuate legs.

11. The lock assembly as recited in claim 10, wherein said step portion extends in a direction of said tab.

12. The lock assembly as recited in claim 1, wherein said at least one tab comprises a first tab and an opposed second tab, said first tab and said second tab each defined within a plane which are not intersected by said axis.

13. The lock assembly as recited in claim 1, wherein said at least one tab is defined within a plane which is not intersected by said axis.

14. The lock assembly as recited in claim 1, wherein said spring catch is defined within a first plane and at least one tab is defined within a second plane transverse to said first plane, neither said first plane nor said second plane intersected by said axis.

15. The lock assembly as recited in claim 1, wherein said cylinder assembly is received along said axis, such that said cylinder assembly contacts said at least one tab prior to contact wit a step portion formed in said spring catch.

16. The lock assembly as recited in claim 15, wherein said cylinder assembly is receivable within said insert along said axis toward said step portion.

17. The lock assembly as recited in claim 15, wherein said step portion extends toward said axis to define an engagement surface within a perimeter defined by said cylinder assembly relative said axis.

18. The lock assembly as recited in claim 17, wherein said step portion is accessible from a direction opposite to a direction said cylinder assembly is receivable within said insert.

19. A front-loading lock assembly comprising:

a knob;

an insert which defines an axis receivable within said knob said insert comprises a first groove about a periphery of said insert, a second groove transverse said first groove and an opening through said second groove;

a cylinder assembly receivable within said insert along said axis; and a retainer comprising a spring catch generally parallel to said axis, said spring catch comprises at least one tab generally parallel to said axis which extends at least partially through said opening to engage said cylinder assembly to secure said cylinder assembly within said insert.

20. The front-loading lock assembly as recited in claim 19, wherein said insert is receivable within a bore in said knob through a rear face of said knob.

21. The front-loading lock assembly as recited in claim 20, wherein said insert is staked into said knob.

22. The front-loading lock assembly as recited in claim 19, wherein said cylinder assembly is receivable through a front face of said knob.

23. The front-loading lock assembly as recited in claim 19, wherein said retainer comprising a first arcuate leg and a second arcuate leg which extend from said spring catch.

24. The front-loading lock assembly as recited in claim 23, wherein said first arcuate leg and said second situate leg extend at least partially around said insert.

25. The front-loading lock assembly as recited in claim 23, wherein said spring catch comprises a tab which extends perpendicularly from said spring catch opposite said first and second arcuate legs.

26. The front-loading lock assembly as recited in claim 25, wherein said spring catch comprises a step portion intermediate said tab and said first and second arcuate legs.

27. The front-loading lock assembly as recited in claim 19, wherein said insert is received within said knob from a first direction and said cylinder assembly is received within said insert from a second direction.

* * * * *

UNITED STATES PATENT AND TRADEMARK OFFICE

CERTIFICATE OF CORRECTION

PATENT NO. : 7,104,098 B2
APPLICATION NO. : 10/837789
DATED : September 12, 2006
INVENTOR(S) : Romero et al.

It is certified that error appears in the above-identified patent and that said Letters Patent is hereby corrected as shown below:

Claim 15, Column 5, line 25: "wit" should be --with--

Claim 24, Column 6, line 25: "situate" should be --arcuate--

Signed and Sealed this

Twelfth Day of December, 2006

JON W. DUDAS
*Director of the United States Patent and Trademark Office*